US007001151B2

(12) United States Patent
Wang et al.

(10) Patent No.: US 7,001,151 B2
(45) Date of Patent: Feb. 21, 2006

(54) GAS TURBINE BUCKET TIP CAP

(75) Inventors: John Z. Wang, Greenville, SC (US); Mark J. Bailey, Simpsonville, SC (US); Robert R. Berry, Rolling Hills Estates, CA (US); Emilio Fernandez, Taylors, SC (US)

(73) Assignee: General Electric Company, Schnectady, NY (US)

( * ) Notice: Subject to any disclaimer, the term of this patent is extended or adjusted under 35 U.S.C. 154(b) by 78 days.

(21) Appl. No.: 10/708,417

(22) Filed: Mar. 2, 2004

(65) Prior Publication Data

US 2005/0196277 A1 Sep. 8, 2005

(51) Int. Cl.
*F01D 5/18* (2006.01)

(52) U.S. Cl. ..... 416/92; 416/96 R; 416/241 R; 415/173.1

(58) Field of Classification Search ..... 416/92, 416/96 R, 241 R; 415/173.1
See application file for complete search history.

(56) References Cited

U.S. PATENT DOCUMENTS

| | | | | |
|---|---|---|---|---|
| 3,533,712 | A | | 10/1970 | Kercher |
| 3,615,375 | A | | 10/1971 | Beltran et al. |
| 3,628,885 | A | | 12/1971 | Sidenstick et al. |
| 3,635,585 | A | | 1/1972 | Metzler |
| 3,899,267 | A | | 8/1975 | Dennis et al. ..... 416/92 |
| 3,982,851 | A | * | 9/1976 | Andersen et al. ..... 416/92 |
| 4,010,531 | A | | 3/1977 | Andersen et al. |
| 4,073,599 | A | * | 2/1978 | Allen et al. ..... 416/97 R |
| 4,247,254 | A | | 1/1981 | Zelahy ..... 416/97 R |
| 4,540,339 | A | | 9/1985 | Horvath ..... 416/92 |
| 4,589,824 | A | * | 5/1986 | Kozlin ..... 416/97 R |
| 4,893,987 | A | | 1/1990 | Lee et al. ..... 416/92 |
| 5,026,522 | A | * | 6/1991 | Jackson et al. ..... 420/426 |
| 5,183,385 | A | | 2/1993 | Lee et al. ..... 416/97 R |
| 5,348,446 | A | | 9/1994 | Lee et al. ..... 416/241 R |
| 5,660,523 | A | | 8/1997 | Lee ..... 416/97 R |
| 5,738,491 | A | | 4/1998 | Lee et al. ..... 415/177 |
| 5,794,338 | A | | 8/1998 | Bowden, Jr. et al. ..... 29/889.1 |
| 6,056,507 | A | | 5/2000 | Wheat et al. |
| 2002/0187044 | A1 | | 12/2002 | Lee et al. ..... 416/97 R |
| 2002/0197160 | A1 | | 12/2002 | Liang ..... 416/92 |
| 2003/0021684 | A1 | | 1/2003 | Downs et al. ..... 416/92 |

FOREIGN PATENT DOCUMENTS

EP 0 8165 636 B1 4/1995

* cited by examiner

*Primary Examiner*—Ninh H. Nguyen
(74) *Attorney, Agent, or Firm*—Sutherland Asbill and Brennan LLP

(57) ABSTRACT

A tip cap for a turbine blade. The tip cap may include a HS-188 sheet material with a thickness of less than about 0.079 inches (about 2 millimeters) and a number of holes positioned in the sheet material.

16 Claims, 3 Drawing Sheets

GAS TURBINE BUCKET TIP CAP

BACKGROUND OF INVENTION

The present invention relates to gas turbine blades or buckets and more particularly relates to a turbine blade tip cap with a number of cooling holes therein.

Gas turbine components are exposed to the very high temperatures of the combustion gas flow therethrough. The components generally are cooled by a means of a cooling airflow so as to maintain structural integrity and promote longevity. Efficient use of the cooling airflow not only may prolong the life of the turbine blades but also may promote overall lower engine operating costs.

The gas turbine blades or buckets pose a particular technical challenge for cooling. The tip portion generally includes a tip cap and also may include a tip squealer extending radially away from the tip cap. The tip squealer provides rub tolerance in the event that the tip clearance is diminished during turbine operation. The tip squealer further increases the challenge of cooling the tip because access to the squealer generally is limited.

Known cooling methods generally include several cooling holes positioned within the tip cap. The holes generally extend from a cooling passage or passages within the blade through the tip cap. The stresses and high temperatures present during normal operation of the turbine, however, may cause excessive oxidation, cracking, and creep bulging in the known tip caps.

In addition to cooling, the holes in the tip cap allow dust in the blade to vent. This venting also may improve overall efficiency. The tip cap also serves to close the blade core. Such closure is required for casting.

There is a desire, therefore, to optimize the shape of the tip cap. The tip cap may optimize the cooling fluid flow therethrough, allow dust to vent, and provide improved material characteristics.

SUMMARY OF INVENTION

The present invention thus provides a tip cap for a turbine blade. The tip cap may include a HS-188 sheet material with a thickness of less than about 0.079 inches (about 2 millimeters) and a number of holes positioned in the sheet material.

The tip cap may include six (6) holes. Each of the holes may include a diameter of about 0.04 inches (about 1.06 millimeters). The holes may be positioned on the sheet material according to the coordinates set forth in Table I. The sheet material may include a thickness of about 0.062 inches (about 1.57 millimeters). A weld may be created by electron beam welding so as to attach the tip cap to the turbine blade.

A further embodiment may provide for a tip cap for a turbine blade. The tip cap may include a sheet material and a number of holes positioned within the sheet material. The holes may include a position on the sheet material according to the coordinates set forth in Table I.

The sheet material may have a thickness of less than about 0.079 inches (about 2 millimeters). The thickness may be about 0.062 inches (about 1.57 millimeters). The sheet material may include a HS-188 sheet material. Each of the holes may include a diameter of about 0.04 inches (about 1.06 millimeters).

A further embodiment may provide for a turbine blade. The turbine blade may include an airfoil and a tip cap position about a first end of the airfoil. The tip cap may include a sheet material with a thickness of less than about 0.079 inches (about 2 millimeters) and a number of holes positioned therein. Six (6) holes may be used.

The holes may include a diameter of about 0.04 inches (about 1.06 millimeters). The holes may be positioned on the sheet material according to the coordinates set forth in Table I. The sheet material may include a thickness of about 0.062 inches (about 1.57 millimeters). A weld created by electron beam welding may attach the tip cap to the first end of the airfoil.

These and other features of the present invention will become apparent upon review of the following detailed description of the preferred embodiments when taken in conjunction with the drawings and the appended claims.

DETAILED DESCRIPTION

Figure 1:
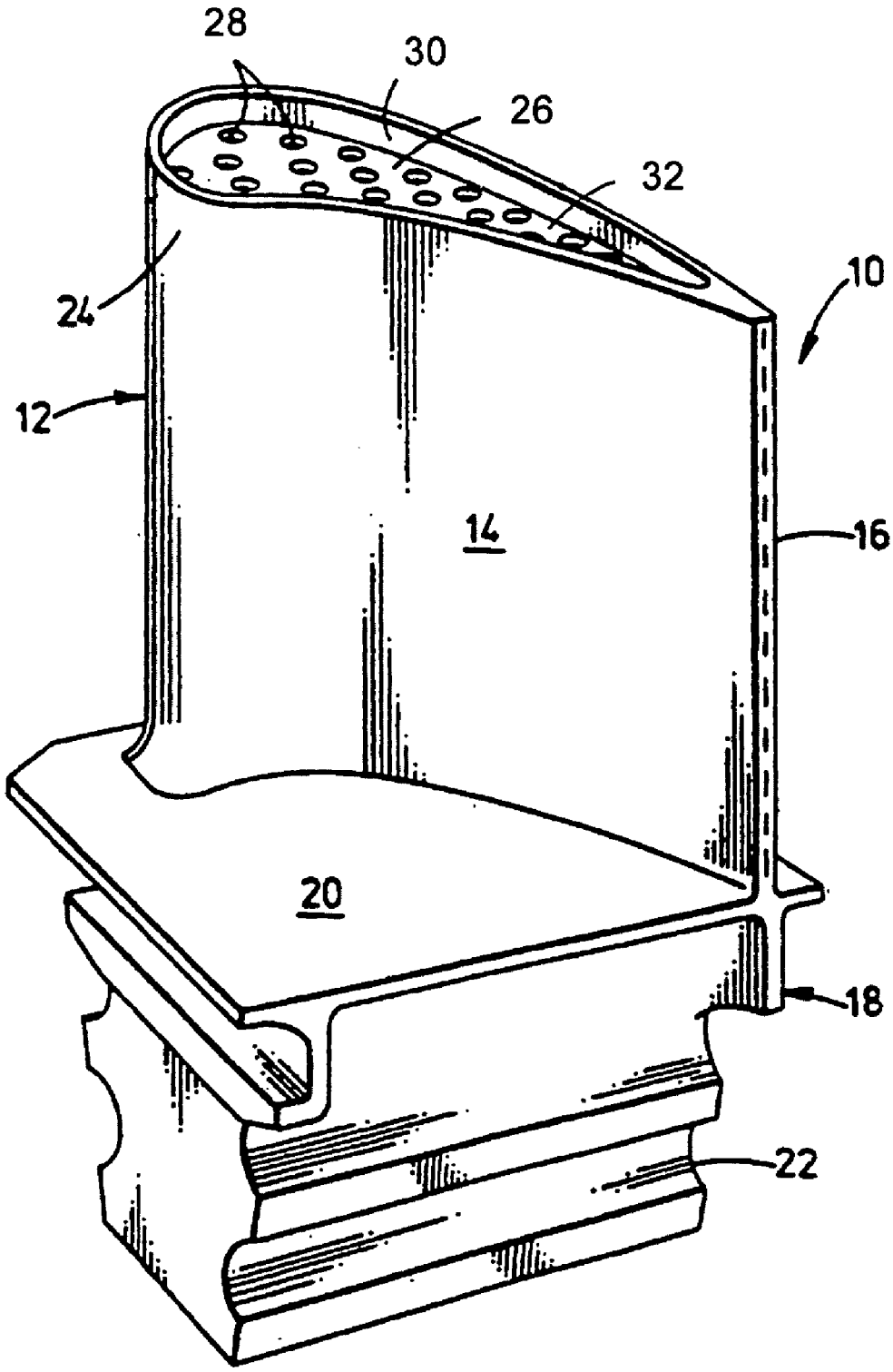
FIG. 1 (PRIOR ART)
FIG. 1 is a perspective view of a prior art turbine blade having a tip cap with cooling holes therein.

Referring now to the drawings, in which like numerals indicate like elements throughout the separate views, FIG. 1 shows a prior art gas turbine bucket or blade 10. The bucket or blade 10 may include an airfoil portion 12 having a pressure side 14 and a suction side 16. The airfoil 12 also may include a base 18 for mounting the airfoil 12 to a rotor. The base 18 may have a platform 20 rigidly mounting the airfoil 12 and a root 22 for attaching the blade 10 to the rotor.

At an outer end portion 24, the airfoil 12 may have a tip cap 26. The tip cap 26 may have a number of cooling holes 28 positioned therethrough. The cooling holes permit the passage of the cooling airflow from the interior of the blade 10 so as to cool the tip cap 26 and to allow dust to vent therethrough. A squealer tip 30 also may surround the tip cap 26. Specifically, the tip cap 26 may sit in a tip recess 32 surrounded by the squealer tip 30.

Figure 2:
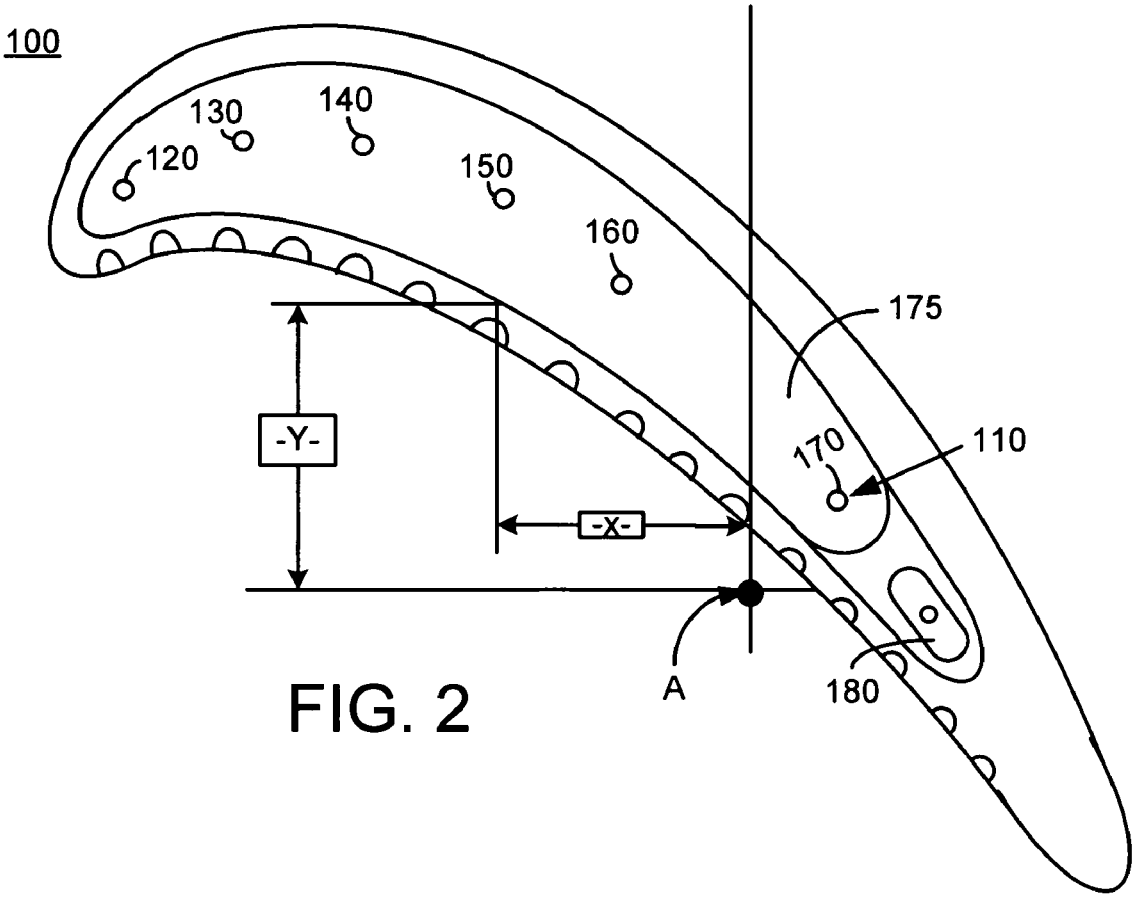
FIG. 2 is a top plan view of a tip cap as described herein positioned on a turbine blade.
Figure 3:
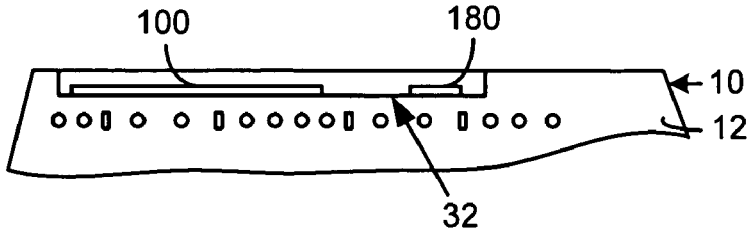
FIG. 3 is a side cross-sectional view of the tip cap within the turbine blade of FIG. 2.
Figure 4:
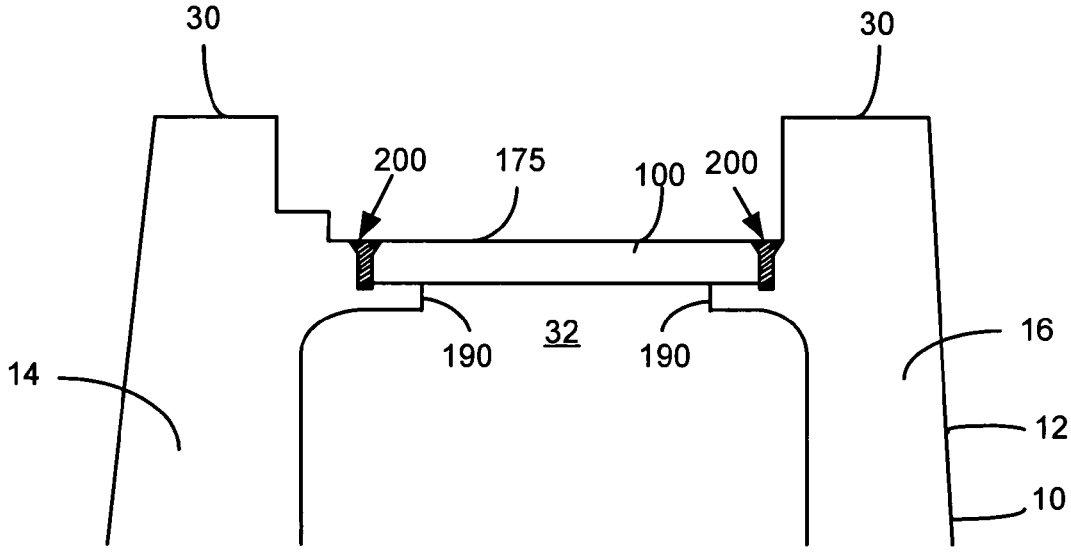
FIG. 4 is a further side cross-sectional view of the tip cap within the turbine blade of FIG. 2.

FIGS. 2–4 show an example of a tip cap 100 of the present invention. The tip cap 100 generally has the shape of the airfoil 12 or a portion thereof. The tip cap 100 may have a number of cooling holes 111 extending therethrough. Specifically, a first cooling hole 120, a second cooling hole 130, a third cooling hole 140, a fourth cooling hole 150, a fifth cooling hole 160, and a sixth cooling hole 170. The cooling holes 110 may have a specific position along the tip cap 100. Table I below shows the coordinate values for the X and Y coordinates expressed in inches (and in millimeters) for each cooling hole 110 from a Point A as is shown:

TABLE 1

| Hole | X | Y |
|---|---|---|
| 120 | −1.572 inch<br>(−39.93 mm) | 0.467 inch<br>(11.86 mm) |
| 130 | −1.336 inch<br>(−33.93 mm) | 0.605 inch<br>(15.37 mm) |
| 140 | −1.060 inch<br>(−26.92 mm) | 0.680 inch<br>(17.27 mm) |
| 150 | −0.702 inch<br>(−17.83 mm) | 0.681 inch<br>(17.30 mm) |

TABLE 1-continued

| Hole | X | Y |
|---|---|---|
| 160 | −0.373 inch (−9.47 mm) | 0.560 inch (14.22 mm) |
| 170 | 0.091 inch (2.31 mm) | 0.158 inch (4.01 mm) |

Each cooling hole 110 may have a diameter of about 0.04 inches (plus or minus about 0.002 inches) (about 1.06 millimeter plus or minus about 0.05 millimeter). The cooling hoes 110 may pass through the tip cap 100 in a substantially perpendicular fashion to the tip cap surface. The position of these cooling holes 110 has been found to optimize the cooling of the tip cap 100.

The tip cap 10 may have a thickness of about 0.062 inches (about 1.57 millimeters). The thickness of the tip cap 100 also has been found to maximize to cooling of the tip cap 100.

The tip cap 100 may be made from a sheet material 175. Specifically, a HS-188 sheet material (AMS 5608). HS-188 may be a metal alloy, specifically a Haynes Super Alloy. The material has superior oxidation resistance and weldability. (Known tip caps used IN 625 with a thickness of about 0.05 inches (about 1.27 millimeters.)) The use of this material for the tip cap 100 also has been found to maximize to cooling of the tip cap 100 as well as provide the improved oxidation resistance and weldability.

The tip cap 100 may be used with a bucket or blade 10 such as a stage one blade of a "7FA+E"turbine sold by the General Electric Company of Schenectady, N.Y. Such a turbine may use ninety-two (92) of the blades 10 and the tip caps 100.

As is shown in FIGS. 2–4, the tip cap 100 may be placed within the tip recess of a blade 10. The tip cap 100 may not completely fill the recess 32. Rather, a second tip cap 180 also may be used. The tip cap 100 may sit on a tip cap shelf 190 within the recess 32 and may be held in place by one or more welds 200. Electron beam welding or similar welding methods may be used.

The tip cap 100 also may be used to repair existing blades 10. The existing tip cap 25 may be evaluated for oxidation, deformation, and cooling hole 28 depth. If necessary, the existing tip cap 25 may be removed and replaced with the tip cap 100 herein. Such a replacement also may increase the overall life of the bucket or blade. The combination of the material selection, the thickness of the material, the number of cooling holes 110, and the location of the cooling holes 110, individually and collectively, may provide the tip cap 100 herein with improved oxidation and creep resistance. This improved resistance may increase the life of the blade 10 and improve the overall efficiency of the turbine.

It should be understood that the foregoing relates only to the preferred embodiments of the present invention and that numerous changes and modifications may be made herein without departing from the general spirit and scope of the invention as defined by the following claims and the equivalents thereof.

We claim:

1. A tip cap for a turbine blade, comprising:
a HS-188 sheet material;
said sheet material comprising a thickness of less than about 0.079 inches (about 2 millimeters); and
a plurality of holes positioned in said sheet material wherein said plurality of holes comprises six (6) holes.

2. The tip cap of claim 1, wherein each of said plurality of holes comprises a diameter of about 0.04 inches (about 1.06 millimeters).

3. The tip cap of claim 1, wherein said sheet material comprises a thickness of about 0.062 inches (about 1.57 millimeters).

4. The tip cap of claim 1, wherein said plurality of holes comprises a position on said sheet material according to the coordinates set forth in Table I.

5. The tip cap of claim 1, further comprising a weld created by electron beam welding so as to attach the tip cap to the turbine blade.

6. A tip cap for a turbine blade, comprising:
a sheet material; and
a plurality of holes positioned within said sheet material;
said plurality of holes comprises a position on said sheet material according to the coordinates set forth in Table I.

7. The tip cap of claim 6, wherein said plurality of holes comprises six (6) holes.

8. The tip cap of claim 6, wherein said sheet material comprises a thickness of less than about 0.079 inches (about 2 millimeters).

9. The tip cap of claim 6, wherein said sheet material comprises a thickness of about 0.062 inches (about 1.57 millimeters).

10. The tip cap of claim 6, wherein said sheet material comprises a HS-188 sheet material.

11. The tip cap of claim 6, wherein each of said plurality of holes comprises a diameter of about 0.04 inches (about 1.06 millimeters).

12. A turbine blade, comprising:
an airfoil; and
a tip cap position about a first end of said airfoil;
said tip cap comprising a sheet material;
said sheet material comprising a thickness of less than about 0.079 inches (about 2 millimeters); and
a plurality of holes positioned within said sheet material;
said plurality of holes comprising six (6) holes.

13. The turbine blade of claim 12, wherein each of said plurality of holes comprises a diameter of about 0.04 inches (about 1.06 millimeters).

14. The turbine blade of claim 12, wherein said sheet material comprises a thickness of about 0.062 inches (about 1.57 millimeters).

15. The turbine blade of claim 12, wherein said plurality of holes comprises a position on said sheet material according to the coordinates set forth in Table I.

16. The turbine blade of claim 12, further comprising a weld created by electron beam welding so as to attach said tip cap to said first end of said air foil.

* * * * *